United States Patent [19]

Kydd

[11] 4,407,367

[45] Oct. 4, 1983

[54] METHOD FOR IN SITU RECOVERY OF HEAVY CRUDE OILS AND TARS BY HYDROCARBON VAPOR INJECTION

[75] Inventor: Paul H. Kydd, Lawrenceville, N.J.

[73] Assignee: HRI, Inc., Lawrenceville, N.J.

[21] Appl. No.: 196,771

[22] Filed: Oct. 14, 1980

Related U.S. Application Data

[63] Continuation of Ser. No. 974,552, Dec. 28, 1978, abandoned.

[51] Int. Cl.[3] ..... E21B 43/24; E21B 43/40

[52] U.S. Cl. ..... 166/267; 166/303; 166/304; 166/306

[58] Field of Search ..... 166/265, 266, 267, 272, 166/303, 304, 306

[56] References Cited

U.S. PATENT DOCUMENTS

| | | | |
|---|---|---|---|
| 895,612 | 8/1908 | Baker | 166/272 X |
| 1,422,204 | 7/1922 | Hoover et al. | 166/272 X |
| 2,265,923 | 12/1941 | Normand | 166/303 |
| 2,412,765 | 12/1946 | Buddrus et al. | 166/267 X |
| 2,862,558 | 12/1958 | Dixon | 166/272 |
| 3,126,951 | 3/1964 | Santourian | 166/306 X |
| 3,126,961 | 3/1964 | Craig, Jr. et al. | 166/306 X |
| 3,358,756 | 12/1967 | Vogel | 166/272 X |
| 3,698,478 | 10/1972 | Parker | 166/272 X |
| 3,730,270 | 5/1973 | Allred | 166/303 X |
| 3,768,559 | 10/1973 | Allen et al. | 166/272 |
| 3,822,749 | 7/1974 | Thigpen, Jr. | 166/303 |
| 3,881,550 | 5/1975 | Barry | 166/272 |
| 4,022,277 | 5/1977 | Routson | 166/267 |
| 4,034,812 | 7/1977 | Widmyer | 166/303 |

*Primary Examiner*—James A. Leppink
*Assistant Examiner*—George A. Suchfield
*Attorney, Agent, or Firm*—V. A. Mallare; F. A. Wilson

[57] ABSTRACT

The recovery of heavy crude oils and tars from subterranean oil bearing formations is enhanced by the injection of pressurized and heated hydrocarbon vapor into a single well drilled into the formation. Condensation of the hydrocarbon vapor heats the heavy oil and tars entrapped in the formation and dilutes the oil so as to decrease its viscosity and enhance its flow into a lower portion of the well. The oil and solvent collected are removed to the surface by pumping. The preferred hydrocarbon vapor is a low boiling fraction derived by distillation of the oil recovered from the formation, however, some stable externally-produced aromatic hydrocarbon vapors of high solvent power such as benzene or toluene or mixtures thereof may also be used and reclaimed from the oil by distillation.

1 Claim, 2 Drawing Figures

METHOD FOR IN SITU RECOVERY OF HEAVY CRUDE OILS AND TARS BY HYDROCARBON VAPOR INJECTION

This is a continuation of application Ser. No. 974,552, filed Dec. 28, 1978, now abandoned.

BACKGROUND OF THE INVENTION

1. Field of the Invention

This invention pertains to the enhanced recovery of heavy crude oils and tars from subterranean formations containing same, and particularly to the injection of hot hydrocarbon vapors into the formation for heating the formation and extracting the oil therefrom using a single wellbore.

2. Description of Prior Art

Steam injection is the only enhanced recovery method for low gravity oils which is commercially practiced to a significant extent at the present time. The probable future of oil recovery by this method is described in the recent report "Enhanced Oil Recovery, An Analysis of the Potential for Enhanced Oil Recovery from Known Fields in the United States—1976 to 2000," National Petroleum Council, December 1976. Two basic techniques are generally used: steam stimulation involving alternate steam injection and oil recovery procedures (huff and puff) usually from the same hole, and steam drive of oil from injection wells to separate recovery wells. Both techniques are described in the above report on pages 13–15.

Unfortunately, steam injection for recovery of heavy oils is very expensive in energy due to the fact that it is necessary to heat a substantial portion of the subterranean oil bearing formation, and extraneous rock as well, to the saturation temperature of steam. The enhanced oil recovery effect is achieved substantially thermally by heating an entrapped oil to reduce its viscosity, and then physically by driving the oil out of the formation to a recovery well using differential steam pressure. The recovery of heavy oils using steam has been only partly successful, due in part to the immiscibility of water and oil. Some formations such as tar sands are totally impermeable to steam or other gases until the bitumen content has been extracted, whereupon they are very permeable. Other formations are subject to swelling and other damage.

A major problem with steam injection and with production of heavy oils generally is the tendency to form water-oil emulsions, which are difficult to break chemically and also have very high viscosities. Typically, for a heavy crude oil with a viscosity of 20,000 centipoise, the water-oil emulsion viscosity may reach 100,000 centipoise. Another major problem is establishing and maintaining satisfactory fluid communication between the injection and producing wells, particularly in formations such as tar sands which are usually essentially impermeable. Also in the "huff and puff" method of oil recovery using single wells, the alternate heating and cooling of the steel casing causes a major thermal expansion problem.

Light hydrocarbon diluents are widely used in the production of heavy oils to reduce viscosity and improve pumpability of the oil in the well, but these diluents are injected into the well as liquids to achieve this improvement. Injection of hydrocarbon diluents can also be used to repair formation damage caused by steam or water injection and can improve production by dissolving asphaltenes and other poorly soluble materials that are precipitated near the well bore. However, locating a supply of suitable diluent has become a major problem, and the diluent is a major cost in the production of heavy oil since it is sold as a mixture with the product, usually at a lower price than that of the diluent itself.

In the development of the present invention, it was unexpectedly found that these oil recovery problems can be overcome by the injection of a hot hydrocarbon solvent vapor into the formation rather than steam, using single wells. The general use of solvents in assisting production of heavy oils from formations is known. Also, solvents have been used in vapor form or partially vapor form and have achieved their effect by dilution and solubilization of the heavy oil. For example, U.S. Pat. No. 3,608,638 to Terwilliger discloses injecting various solvent vapors into oil formations such as tar sands to facilitate oil recovery from a separate production well spaced from the injection well. Other pertinent disclosures are provided by U.S. Pat. No. 3,515,213 to Prats and U.S. Pat. No. 3,695,354 to Dilgren, et al. for shale oil recovery from permeable zones in shale formations made permeable by fracturing and using various heated fluids.

Another major problem in production of heavy oils which frequently occurs in unconsolidated tar sands is "sanding" in the wells, which severely restricts the flow of oil from the formation into the well. Sanding problems are usually severely aggravated by steam and water injection, which mobilizes the adjacent sand and causes a considerable flow of sand and clay particles into the well along with the oil and water produced. I have shown in the development of the present invention that the use of solvent vapor inhibits such sanding and that a much cleaner oil is produced than with steam injection. Furthermore, the low viscosity of the oil-solvent mixture produced allows residual sediment to settle out efficiently, either in the well or in storage tanks above ground.

Accordingly, it is an object of this invention to provide a process for recovery of heavy crude oils and tars from subterranean formations by injecting a heated hydrocarbon vapor into the formation.

It is also an object of the invention to perform the vapor injection and oil recovery in single wells separated into injection and recovery portions or zones to avoid dependence on fluid communication between adjacent wells.

It is another object of the invention to reduce sanding of wells by using a compatible hydrocarbon vapor rather than steam or water injection.

It is still another object of the invention to recover the injected hydrocarbon vapor by a distillation step performed in the oil field, and to eliminate water from the oil and prepare it for shipment as a hot, dry liquid.

Other objects of the invention will become apparent in the description of the invention and preferred embodiments.

SUMMARY OF THE INVENTION

In accordance with the invention, a substantial improvement to in situ recovery of heavy crude oils and tars from subterranean formations by conventional steam injection practices is provided by injecting hydrocarbon vapor into a well located in an oil bearing formation rather than injecting steam. The hydrocarbon solvent is heated and vaporized above ground and is then injected as a hot vapor into a well containing a casing and in which fluid communication, to the extent that it is required, is provided between an upper portion and a lower portion in the formation, rather than laterally between adjacent wells. The hot solvent vapor passes into the oil bearing formation and condenses in the formation, thereby enhancing the recovery of heavy oil by heating the oil and lowering its viscosity, by dissolving the oil and rendering it liquid, and by diluting the oil and lowering its viscosity. In this way, a physical and chemical effect is achieved by solubilizing and diluting the oil in combination with heating and expanding it. The resulting extracted oil along with some condensed solvent drains from the formation into the lower end of the well hole and is pumped to above ground.

It is thus possible to recover substantially more of the heavy oil by such a vapor extraction operation, or by effectively vapor degreasing the formation, than by simply heating it as with steam injection. Also, the heat input required for such oil extraction using hot hydrocarbon vapor will be much less than for steam, due to the lower heat of vaporization of the hydrocarbon material injected and its greater solvent effectiveness.

The injection of hot hydrocarbon vapor into the formation and recovery of the oil produced is most advantageously performed in single wells using vertical fluid communication within the formation between the injection and producing zones of the well, rather than by horizontal fluid communication between separate adjacent wells. In this way, the problems of creating and maintaining satisfactory fluid communication between separate wells in low permeability formations such as in tar sands are avoided. Such lateral fluid communication is made more difficult by the fact that many heavy oil and tar sand deposits are essentially completely impermeable. Even in cases where some permeability exists naturally, it is uncertain and unreliable and many enhanced recovery projects have failed because of inadequate permeability in the desired direction, or excessive permeability in unexpected and undesired directions.

As an additional advantage of the invention, this hot vapor injection process can be and preferably is made continuous, with the injection of hydrocarbon vapor into the oil-containing formation occurring near the top of the formation and the removal of condensed solvent vapor and extracted oil occurring from nearer the bottom of the formation. In this way, relatively continuous production of oil is maintained and repeated thermal expansion problems in the well casing are avoided.

The hydrocarbon solvent used should be vaporizable at temperatures which will not cause appreciable cracking of either the solvent or the oil in the formation and should be miscible in the oil. The solvent should be heated to as hot as possible without causing appreciable cracking of the material as it passes down the casing, so as to enter the formation in substantially vapor form. Preferred solvents are aromatic hydrocarbons or mixtures of hydrocarbons containing substantial amounts of aromatic hydrocarbon materials. Examples of such hydrocarbon solvents are benzene, toluene, xylene, naphtha, pyrolysis gasoline, and other aromatic mixtures having a boiling point range of about 200°–400° F. The vapor temperature at the well head should be at least about 300° F., and preferably should be 500°–700° F. The pressure of the hot vapor should be as high as necessary to inject it into the oil bearing formation, and will usually be within the range of 50–500 psig depending upon the depth and porosity of the formation.

The recovered mixture of heavy oil and condensed solvent is pumped from the well as a free-flowing liquid and subjected to distillation. In the course of distillation, the solvent fraction is revaporized and reclaimed for reuse. In some cases additional solvent will be reclaimed from the crude oil itself to make up for some losses of condensed solvent remaining in the formation, thereby reducing or avoiding the necessity to purchase external supplies of solvent or diluent. Fuel needed for providing heat to the distillation step is either a purchased refined fuel or a portion of the heavy oil produced from the formation, the choice usually depending on which is the most economical solution from an evironmental pollution standpoint.

Such injection of hot solvent vapor as per this invention eliminates the tendency to form oil-water emulsions in the formation, and improves dramatically the viscosity of the heavy oil produced. In the distillation process, residual water will also be evaporated from the crude, which will be ready for shipment as a warm low viscosity liquid substantially free of water and sediment.

The light fractions of the recovered oil provide the most convenient source for the hydrocarbon solvent vapors needed for injection and they can be obtained in the field by partial distillation of the recovered crude oil. In some oil fields it may be advantageous to improve the solvent power of the injected hydrocarbon vapor by adding an externally produced aromatic hydrocarbon material, such as benzene or toluene. Portable skid mounted distillation equipment is provided at the well site to accomplish this oil fractionation and blending in the field.

As recovery of oil continues from adjacent individual wells being produced, the recovered areas will ultimately coalesce and fluid communication between adjacent wells will be established. But this condition is not an essential feature of the present invention and serves only to provide a further stage of the recovery of oil and injected solvent from the formation.

DESCRIPTION OF PREFERRED EMBODIMENTS

Figure 1:
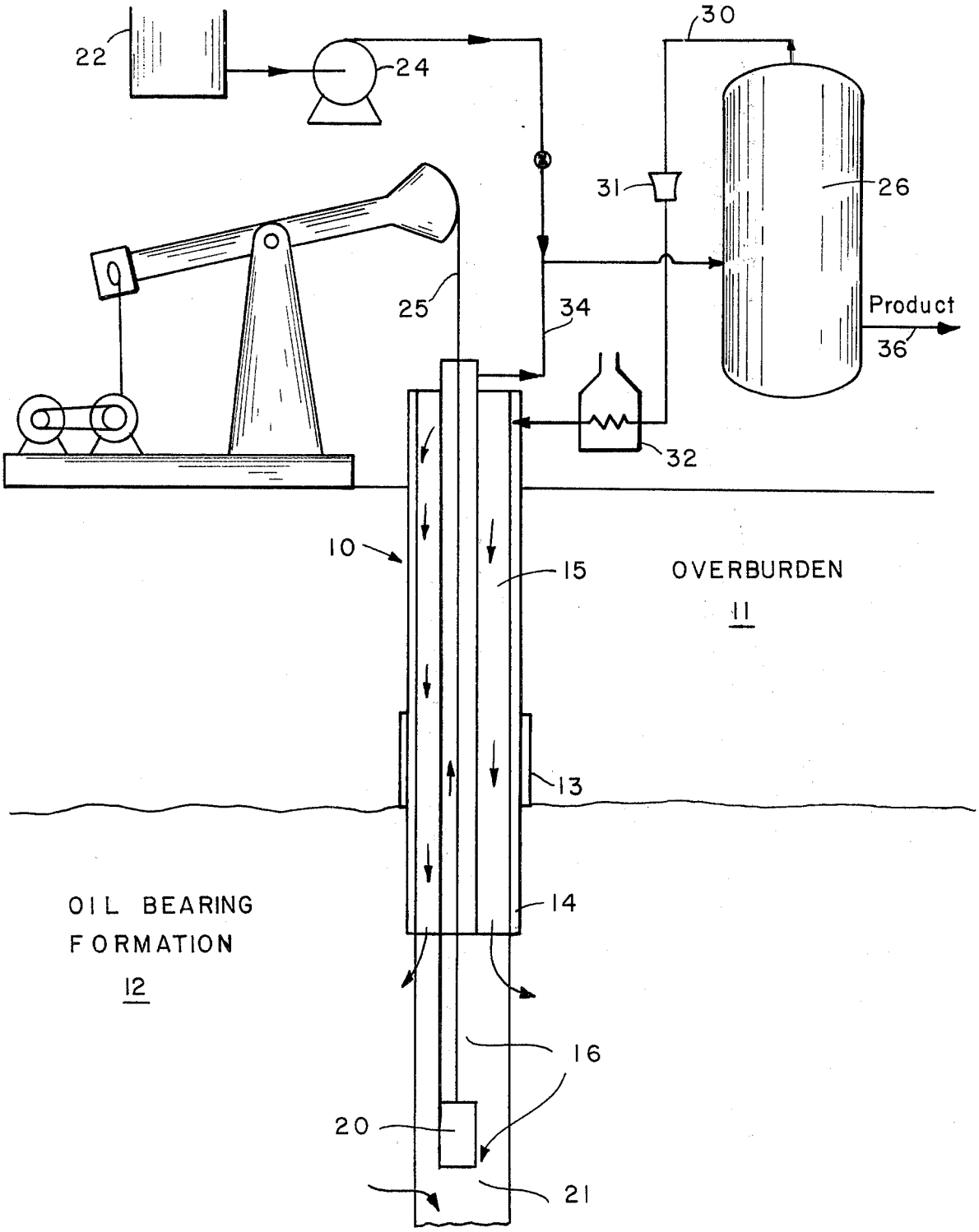
FIG. 1 shows a typical oil well and hydrocarbon vapor generating equipment for hot vapor injection into and oil recovery from an oil or tar bearing formation.

As illustrated by FIG. 1, a bore hole generally indicated at 10 is drilled through overburden 11 into an oil-bearing formation 12, which may preferably be a tar sands formation such as the Athabasca tar sands located in Alberta, Canada, or the Utah tar sands of the United States. Casing 14 is inserted into borehole 10 and cemented in place at 13 within the overburden 11. Inner tubing string 16 is installed within the casing 14 and extends to the bottom of the hole. Pump 20 is provided in the inner tubing 16 at its lower end for recovery of oil from the formation by pumping in accordance with established practice in the industry.

A hydrocarbon solvent liquid at 22, containing principally benzene, toluene, zylene or mixtures thereof, is initially pressurized sufficiently at 24 to pass it into heated still 26 where it is vaporized at a sufficient pressure to force the hydrocarbon vapor through annular space 15 and into the oil bearing formation 12. Typically, heavy oil and tar deposits are found at depths less than 1000 feet, requiring a vapor pressure of approximately 500 psig or less. In most cases it is desirable to superheat the vapor to overcome heat losses which occur in piping the vapor to the individual well and down to the formation, and to permit condensation of the hydrocarbon vapor only in the oil bearing formation. This could be preferably accomplished with a superheater passage incorporated into the still 26, or by a pressure reducing valve or orifice in the vapor line at 31. Another alternative is to provide a separately fired heater 32 to superheat the vapor being injected.

The hot hydrocarbon solvent vapor passes down annular space 15 and into the oil bearing formation 12. In the formation the hot hydrocarbon vapor cools, condenses and reacts with the heavy oils and/or tars entrapped therein to heat and solubilize them and thereby reduce their viscosity. The resulting reduced viscosity oil flows into sump 21 at the bottom end of inner tubing 16. From this sump 21 the oil is lifted to the surface by a pump 20 driven by sucker rod 25 in accordance with well established practice in the industry.

Other type lift pumps, such as a down hole electric or gas driven pump could also be used. A pump located at the bottom of the well is desirable from several points of view. It reduces the bottom hole pressure and thus promotes flow of oil to the production tubing 16. Also, it lowers the temperature at which the solvent is in the vapor form and can more easily penetrate the formation, and therefore lowers the temperature to which the formation 12 must be heated to recover the oil. Finally, it raises the pressure of the liquid mixture being pumped up through production tubing 16, thus preventing it from being boiled by the downward flowing hot vapor stream and extracting heat therefrom.

The recovered oil and condensed hydrocarbon liquid at 34 is passed to the still 26, where it is heated and sufficient solvent vapor recovered as overhead stream 30 for injection as pressurized vapor into the well casing 14. The recovered bottoms oil liquid product is withdrawn from the distillation step at 36.

After continuous operation and recovery of oil is achieved, sufficient hydrocarbon solvent vapor may be generated from the oil produced. In such case, use of external hydrocarbon liquid at 22 for start-up purposes may be reduced or terminated as desired. Alternatively, if desired, an aromatic hydrocarbon liquid having improved solvent power such as benzene or toluene may be added at 22 as needed to improve the recovery of the heavy oils from formation 12.

Fuel for the still 26 may be supplied either by combustion of an externally supplied fuel oil or gas, or by combustion of a portion of the recovered oil product. Combustion of the crude oil product would be the preferred option, unless the cost of stack gas scrubbing and environmental controls outweighed the fuel cost advantages of burning the crude oil.

While the individual wells 10 are usually intended to be operated independently, a plurality of wells may be served by a single hydrocarbon solvent vapor supply and distillation unit. Typically for wells producing at the rate of about 20–25 Bbl/per day with a solvent flow equal to about 20 times the oil produced and quarter acre or 100 ft. well spacing, a convenient size distillation unit burning about 25–30 gal. per hour of the product will serve three wells. The distillation unit will preferably be a simple direct fired pressure vessel mounted on a skid and capable of being moved from well site to well site as oil production from the individual groups of three wells become exhausted. The wells would be preferably arranged as an equilateral triangle, with spacing of more than about 60 feet but less than 600 feet.

The operation and benefits of this invention will be further illustrated by reference to the following examples and experiments, which should not be construed as limiting the scope of this invention.

EXAMPLE 1

To achieve realistic conditions for experiments on oil recovery from heavy oil formations such as tar sands deposits, it is essential to achieve a thoroughly compacted and nearly impermeable structure closely representative of the original tar sands material in place underground. To provide such a simulated tar sands formation, Utah tar sand, having characteristics as described in Table 1, was hot packed into a pressurizable vessel 10 inch diameter by 10 inch deep and allowed to cool, thereby closely simulating the permeability of the sand in its original undisturbed condition. The pressure vessel was provided with an ¼" pipe nipple (0.360 inch inside diameter) injection port centrally located in the top and a perforated ¼ inch pipe drain port centrally located in the bottom. Approximately 22,000 grams of tar sand material was packed into the vessel at a temperature of 250° F. so as to leave a cored vertical hole through the center of the sand, and allowed to cool to ambient temperature.

TABLE 1

CHARACTERISTICS OF UTAH TAR SAND
Formation Location: Vernal County, Utah

| Tar Sand As-Received | | |
|---|---|---|
| Density | 2.164 grams/cc | |
| Water | 2.40 W % | |
| Oil | 11.6 W % - Toluene Soluble | |
| Specific Heat | | |
| | Temperature | |
| Calories/Gram | °C. | °F. |
| 0.377 | 100 | 212 |
| 0.387 | 120 | 248 |
| 0.397 | 140 | 284 |
| 0.405 | 160 | 320 |
| 0.414 | 180 | 356 |
| 0.427 | 200 | 392 |
| Extracted Oil (Toluene Soluble, Toluene Free) | | |
| °API Gravity | 8.6 | |
| Sulfur, W % | 0.35 | |
| Viscosity | | |
| Centipoise | | °F. |
| 1487 | | 175 |
| 874 | | 190 |
| 414 | | 212 |
| 248 | | 230 |
| Vacuum Distillation | °F. | |
| IBP | 529 | |
| 5 ml | 651 | |
| 10 ml | 750 | |
| 20 ml | 880 | |
| 25 ml | 940 | |
| 30 ml | 975− | 32.46 W % |
| | 975+ | 65.12 W % |
| | Loss | 2.42 W % |
| Oil-Free Sand | | |
| Specific Gravity | 2.363 grams/cc | |
| Comparted Bulk Density | 1.56 grams/cc | |
| Screen Analysis | | |

TABLE 1-continued

| CHARACTERISTICS OF UTAH TAR SAND Formation Location: Vernal County, Utah | |
|---|---|
| Mesh | W % |
| +50 | 26.67 |
| 50–70 | 30.92 |
| 70–100 | 18.43 |
| 100–140 | 7.96 |
| 140–200 | 4.83 |
| 200–325 | 5.24 |
| −325 | 5.96 |

The vessel was closed annd the resulting simulated tar sand formation was contacted with saturated steam at 150 psig pressure in a cyclic mode, simulating conventional "huff and puff" steam injection. Three cycles of steam stimulation raised the average temperature of the sand from 74° F. to 154° F. in about four hours. The oil recovered from the sand and removed from the drain port amounted to only 1.9 grams of a total of 2547 grams of oil present in the tar sand, or 0.075% of the oil contained in the sand. Thus, conventional cyclic steam stimulation was found ineffective in producing useful percentages of the oil from this material, despite the fact that some of the internal sand temperatures near the borehole were over 250° F.

In another similar experiment, 22,000 grams of tar sand was hot packed into the vessel and 20 milliliters of toluene liquid was placed in the injection port prior to each steam stimulation cycle. A total of six cycles of steam "huff and puff" injection during about five hours yielded 32.6 grams of oil, or 0.11% of that present. This was a noticeable improvement though still inadequate recovery, showing that the conventional steam stimulation techniques, even when aromatic solvent is also added, cannot be used very successfully for in situ oil production of tar sands bitumen.

EXAMPLE 2

To evaluate the hydrocarbon vapor injection technique per this invention, 21,300 grams of Utah tar sand was hot packed into the reactor vessel as for Example 1 and allowed to cool to ambient temperature. Toluene vapor was introduced through the injection port at the top of the vessel at pressures up to 50 psig and average temperatures up to about 350° F. Using a cyclic pressurization mode during about 4.5 hours, about 96 grams of oil were recovered from the sand or about 4% of the oil present, thus showing a substantial improvement in oil recovery relative to steam injection or steam plus solvent liquid injection of Example 1. In a continuous operation mode, 158 grams of oil were recovered in four hours, or about 6.5% of that present, showing still better performance for the continuous vapor injection mode. In another test run under similar continuous injection mode conditions with vapor heated to 380° F. average temperature, 19.6 W % of the oil present was recovered. Thus, it is apparent that for increased temperature of the hydrocarbon vapor injected, a corresponding increase in oil recovery from the tar sand is obtained.

Figure 2:
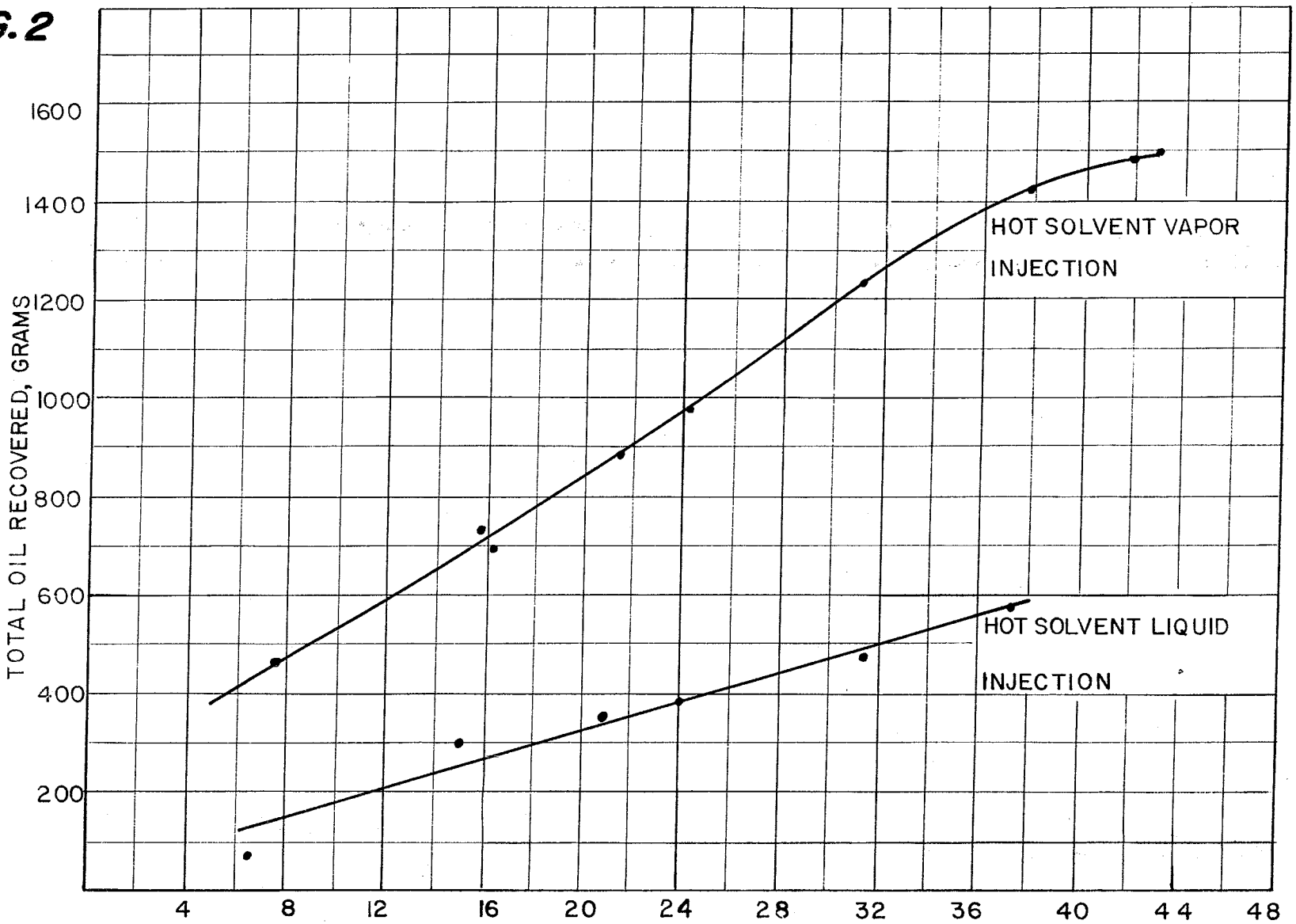
FIG. 2 is a graph showing the improved oil recovery obtained from hot hydrocarbon vapor injection compared to liquid injection into a tar sands formation.

FIG. 2 shows a comparison of the oil recovery obtained from Utah tar sand with continuous solvent liquid injection and with continuous hot solvent vapor injection over about 40 hours duration. It can be seen that the solvent vapor is appreciably more effective in recovering oil from the tar sand than solvent liquid, apparently due to the higher temperature and greater mobility of the vapor. Also it was unexpectedly noted that sand plugging problems (sanding) in the drain holes from the vessel were substantially reduced with solvent vapor injection compared to liquid injection.

EXAMPLE 3

Samples from the Athabasca tar sand deposit in Canada, described in Table 2, and from a California heavy oil sand deposit were also tested in simulated formations using the new recovery method by hot hydrocarbon vapor injection per Example 2. Using the injection of hot toluene vapor, 90.7% of the original oil in place was recovered from Athabasca tar sand, and 90.9% was recovered from the California oil sand. In all cases, the sand in the vicinity of the bore hole was found to be stripped clean and completely free of oil. This volume of completely extracted sand increased in size as the solvent vapor injection continued, with an approximately constant ratio of oil extracted to solvent vapor fed.

TABLE 2

| CHARACTERIZATION OF ATHABASCA TAR SAND | |
|---|---|
| Tar Sand As-Received | |
| Density, gm/cc | 1.93 |
| Water, W % | 1.15 |
| Oil (benzene-soluble), W % | 15.2 |
| Sulfur, W % | 15.2 |
| Sand, W % | 83.65 |
| Extracted Oil (Benzene-Soluble) | |
| Gravity, °API | 8.9 |
| Viscosity, centipoise | |
| @ 175° F. | 315 |
| @ 190° F. | 192 |
| @ 212° F. | 110 |
| @ 230° F. | 70 |
| Vacuum Distillation | |
| IBP | 545° F. |
| 5 ml | 655° F. |
| 10 ml | 712° F. |
| 20 ml. | 765° F. |
| 30 ml | 810° F. |
| 40 ml | 875° F. |
| 50 ml | 940° F. |
| 56 ml | 975° F.− 40.0 W % |
| | 975° F.+ 57.4 W % |
| | Loss, 2.6 W % |
| Oil-Free Sand | |
| Specific Gravity, g/cc | 2.59 |
| Compacted Bulk Density, g/cc | 1.59 |
| Screen Analysis, W % | |
| Mesh | |
| +50 | 23.2 |
| 50–70 | 49.1 |
| 70–100 | 18.5 |
| 100–140 | 4.4 |
| 140–200 | 1.8 |
| 200–325 | 1.7 |
| −325 | 1.4 |

EXAMPLE 4

Solvent reclaiming is also a critical factor in the successful application of this solvent vapor injection method to oil recovery for tar sand formations. It was found during these tests on simulated tar sand formation that the aromatic hydrocarbon solvent dissolves readily in the heavy oil or tar, creating a mushy mixture of tar sands and solvent from which all the solvent does not flow to the drain hole. As a result, some solvent is retained at the interface between the clean, extracted sand area and the original unaffected tar sand. It was found desirable to operate with the highest possible rate of solvent vapor injection without causing solvent vapor breakthrough to the oil recovery point, both to maximize production from a particular well and also to minimize the thickness of the mushy sand zone and the retention of solvent in the formation. A rate of approximately 10 to 20 barrels of solvent evaporated per hour per well with standard 7 inch diameter casing is reasonable. At this rate, the retention of solvent will be approximately 2.2 lb of solvent per square foot of exposed tar sand.

Using the hot vapor injection method of this invention, the wells should be produced until the stripped sand areas from adjacent individual wells intersect, to eliminate as much as possible of the interface between heavy oil and clean sand and to promote maximum recovery and reuse of solvent. Once linkage has been achieved between adjacent wells, a variety of known secondary recovery techniques may be used to recover additional oil and solvent.

Although this invention has been described for the recovery of oil from tar sand deposits, it is also applicable to the secondary recovery of heavy oils remaining in previously pumped oil fields. While the above description discloses a preferred embodiment of my invention, it is recognized that other modifications will be apparent to those skilled in the art. It is understood, therefore, that my invention is not limited only to those specific methods, steps, or combination of same described, but covers all equivalent methods and steps that may fall within the scope of the appended claims.

I claim:

1. A method for recovery of heavy hydrocarbon material such as heavy crude oils and tars from subterranean oil-bearing formation, comprising the steps of:

(a) providing a well hole through overburden into the oil bearing formation and installing casing in at least the overburden portion of the hole;

(b) providing a pressurized heated hydrocarbon solvent vapor and injecting it into the well and into said formation to condense and dissolve and reduce the viscosity of the heavy oil therein and facilitate its flow into the well;

(c) allowing the reduced viscosity oil and condensed solvent liquid mixture to drain into the bottom portion of the well;

(d) pumping the recovered liquids from the well to above ground;

(e) partially distilling the recovered liquid to reclaim at least a portion of the hydrocarbon solvent vapor for reinjection into the well; and (f) using a portion of the recovered oil as fuel to fire and heat distillation step (e).

* * * * *